United States Patent [19]

Miller

[11] 4,346,743

[45] Aug. 31, 1982

[54] PRODUCT BAG FOR AEROSOL CONTAINER AND METHOD OF UTILIZING THE SAME TO FACILITATE FILLING WITH PROPELLANT

[75] Inventor: Teddy Miller, Skokie, Ill.

[73] Assignee: The Continental Group, Inc., Stamford, Conn.

[21] Appl. No.: 218,159

[22] Filed: Dec. 19, 1980

[51] Int. Cl.[3] ..... B65B 3/04

[52] U.S. Cl. ..... 141/3; 141/20; 141/114; 29/469.5; 220/470; 222/386.5

[58] Field of Search ..... 141/2, 3, 18, 20, 10, 141/114; 222/386.5, 389, 95; 220/67, 460, 461, 470; 29/469.5

[56] References Cited

FOREIGN PATENT DOCUMENTS 1601421 10/1981 United Kingdom .

1602293 11/1981 United Kingdom .

*Primary Examiner*—Houston S. Bell, Jr.

*Attorney, Agent, or Firm*—Charles E. Brown

[57] ABSTRACT

This relates to an aerosol container of the type wherein the product is maintained separate from the propellant in a product bag. The propellant is placed into the container around the product bag through an opening in the top of the container, which opening is normally closed by a valve cup. The neck of the product bag is so positioned when the product bag is seated on the container that an annular flange thereof is vertically spaced over an associated container flange so that propellant may flow into the container without holding either the annular flange or the valve cup in an elevated position. The neck is resiliently deformable so that the valve cup may be first positioned on the container and bonded to the annular flange, after which, when the valve cup is released, the neck will axially extend to lift the valve cup to an out-of-the-way position to permit propellant charging.

12 Claims, 5 Drawing Figures

PRODUCT BAG FOR AEROSOL CONTAINER AND METHOD OF UTILIZING THE SAME TO FACILITATE FILLING WITH PROPELLANT

This invention relates in general to use and useful improvements in aerosol containers, and more particularly to an aerosol container wherein the product is placed in a separate axially collapsible bag and a propellant, preferably a gas under pressure, is placed in the container around the bag for the purpose of effecting the collapsing of the bag.

For a period of years the container with a product in the bag was closed and then a propellant added through an opening in the bottom of the container, followed by a suitable sealing of the opening, for example by way of a plug. This construction has numerous disadvantages, and in recent years a separate opening for the propellant has been eliminated by filling the container with the propellant through that opening at the upper end of the container in which the customary valve cup is seated. On the other hand, there have been difficulties in assuring a sufficient spacing of the bag neck relative to the container for the flow of propellant into the container through the valve cup opening.

In accordance with this invention, there has been provided a novel product bag wherein the product bag is of a height such that when it is seated within the container a terminal annular flange of the bag neck is disposed above the container flange defining the upper opening in the container. Thus, there is automatically provided a space through which the propellant may flow into the container around the product bag.

In accordance with this invention, when the valve cup is applied a sealing flange thereof will engage the annular flange of the product bag and automatically clamp it in sealing relation to the container flange.

A special feature of the product bag is that the neck thereof is provided with a resiliently axially inwardly compressible portion which permits an axial collapsing of the product bag neck when the valve cup is initially applied thereto, and when the valve cup is released, the product bag will resiliently axially extend so as to lift the valve cup and to restore the clearance between the product bag annular flange and the container flange for suitable filling of the container with the propellant.

If desired, the valve cup sealing flange may be provided with a suitable adhesive and/or sealant which, when the valve cup is initially placed in position, bonds the product bag annular flange to the valve cup sealing flange so that alignment of the valve cup with the product bag neck is maintained and, as soon as the propellant filling is complete, the valve cup may be readily depressed to clamp the annular flange between the sealing flange and the container flange to form a seal against propellant escape.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
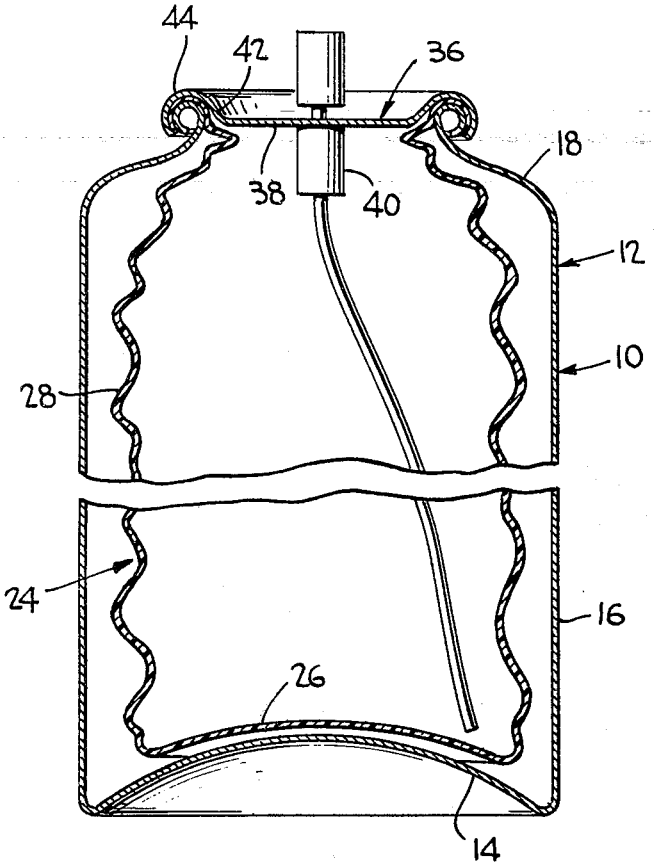
FIG. 1 is a vertical sectional view through an aerosol container formed in accordance with this invention with intermediate portions thereof broken away.
Figure 3:
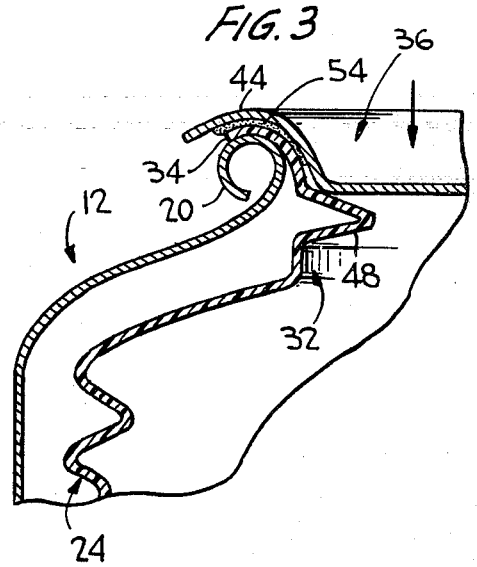
FIG. 3 is a fragmentary sectional view similar to FIG. 2, and shows the valve cup fully seated on the container and clamping the annular flange of the product bag against the container flange, simultaneously assuring alignment of the product bag neck with the container and bonding the product bag annular flange to the valve cup.

Referring now to the drawings in detail, it will be seen that there is illustrated in FIG. 1 an aerosol container formed in accordance with this invention, the aerosol container being generally identified by the numeral 10. The aerosol container 10 includes a can-like container 12 which has a bottom 14, a body 16, and a dome top 18 which terminates in a container flange 20 defining an opening 22 into the interior of the container. The container flange 20 is preferably in the form of a curl.

The container 12 per se is conventional or may be conventional. Accordingly, further description of the container is not necessary here, although it is pointed out that while the container 12 has been illustrated as being of a one-piece construction, it may be of a two- or three-piece construction.

The aerosol container 10 also includes a product bag generally identified by the numeral 24. The product bag 24 is, except for that part thereof which forms this invention, a conventional bag having a bottom 26 and a pleated body 28 which terminates in a shoulder portion 30. The shoulder portion 30 in turn terminates in a neck 32 of a diameter less than the opening 22. The neck 32 has a terminal annular flange 34 which extends radially outwardly and is intended to overlie and seat on the container flange 20. The neck 32, as will be described in more detail hereinafter, is of a novel construction.

The container 12 and the product bag 24 are closed by a valve cup 36. The valve cup 36 is of a conventional construction and includes a recessed end panel 38 which carries a valve unit 40. The valve cup 36 also includes an upstanding chuck wall 42 which surrounds the end panel 38 in a radially outwardly extending sealing flange 44 which is adapted to clamp the annular flange 34 of the product bag to the container flange 20 and then to be crimped around and beneath the container flange 20 as is clearly shown in FIG. 1 to form a sealed container.

The product bag 24 is different from prior product bags in that it is of an overall height such that when it is seated on the container bottom 14, the annular flange 34 thereof is disposed above the container flange 20 in axially spaced relation and defines in combination with the container flange 20 a propellant passage 46. The propellant passage 46 opens into the space between that portion of the container defining the opening 22 and the adjacent portion of the product bag neck 32 whereby a propellant under pressure may be directed into the container 12 in the space surrounding the product bag 24.

In addition to the product bag 24 being of a height to space the annular flange 34 above the container flange 20, the neck 32 is of a construction to facilitate axial collapsing thereof to permit the annular flange 34 to seat on the container flange 20. Specifically, the neck 32 has the major portion thereof in the form of a radially inwardly directed, V-shaped cross-sectional portion or a bead 48. The neck 32 above the V-shaped cross-sectional portion 48 includes a short cylindrical portion 50 which directly carries the annular flange 34. The neck 32 below the V-shaped cross-sectional portion 48 is also preferably in the form of a short cylinder 52 which is directly carried by the shoulder 30 of the product bag.

In accordance with this invention, the underside of the sealing flange 44 is provided with a ring of adhesive and/or sealant 54 which serves to form a bond between the annular flange 34 and the sealing flange 44.

Figure 4:
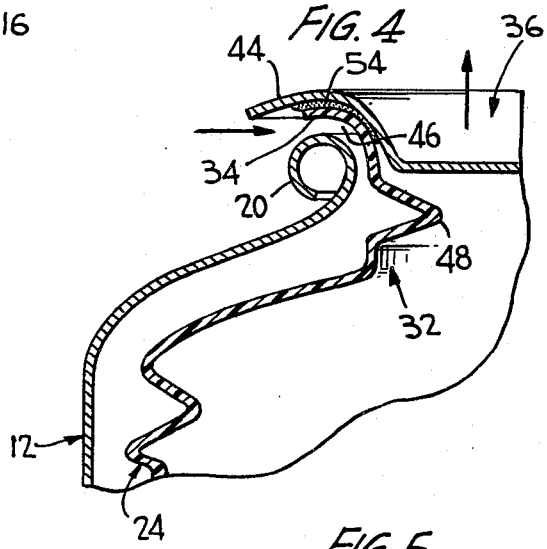
FIG. 4 is a fragmentary sectional view similar to FIGS. 2 and 3, and shows the valve cup released with the product bag lifting the valve cup away from the container and forming a space or opening between the container flange and the product bag annular flange through which a propellant is being charged.
Figure 2:
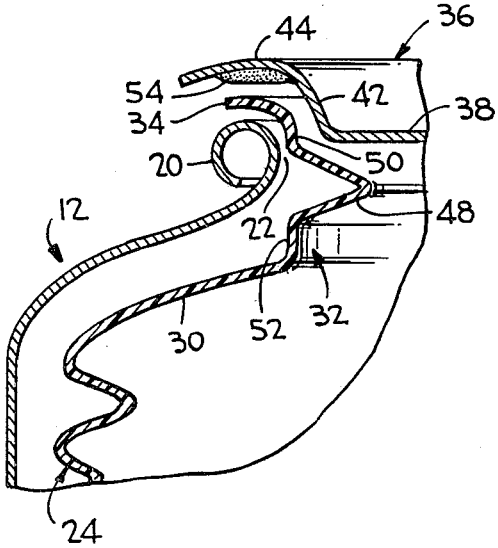
FIG. 2 is an enlarged fragmentary vertical sectional view of the upper portion of the container, showing the product bag in place within the container and a valve cup being positioned relative to the product bag and container.
Figure 5:
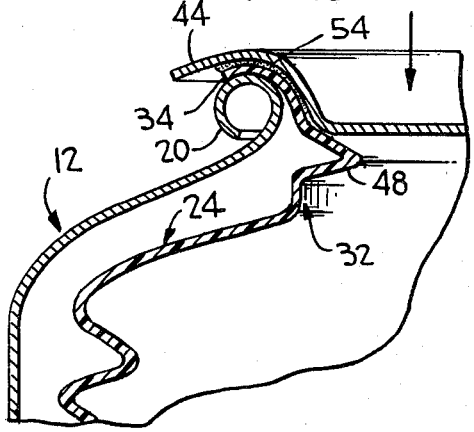
FIG. 5 is a further fragmentary vertical sectional view similar to FIG. 2, and shows the valve cup again axially depressed and in position on the container sealing the container against escape of propellant and ready for the crimping of the sealing flange around the container flange.

In the forming of the aerosol container 10, the product bag 24 is normally placed within the container 12 and then has the product which is to be dispensed placed therein. After filling, the upper portion of the product bag 24 has that relationship with respect to the upper part of the container 12 illustrated in FIG. 2. At the time the valve cup 36 is assembled with the product bag 24 by bringing it down from the top and advancing the valve cup so that it clamps the annular flange 34 against the container flange 20. This aligns the sealing flange of the valve cup 36 to the container, and at the same time the adhesive and/or sealant 54 serves to bond the annular flange 34 to the underside of the sealing flange 44. The valve cup 36 is now released and, as is shown in FIG. 4, the resiliency of the V-shaped neck portion 48 is such as to urge the annular flange 34 upwardly, carrying with it the valve cup 36. As is schematically shown in FIG. 4, a propellant may be charged into the container 12 under the annular flange 34 through the space 46 and down through the opening 22 around the neck 32. Once the charging is completed, the valve cup 36 is again depressed so as to seat the annular flange 34 on the container flange 20 in sealing engagement as shown in FIG. 5. With the valve cup 36 end in this position, the sealing flange 44 is crimped around and under the container flange 20 securely to attach the valve cup 36 to the container 12 in sealed relation against escape of the propellant.

Although only a preferred embodiment of the product bag neck construction has been specifically illustrated and described herein, it is to be understood that minor variations may be made therein without departing from the spirit and scope of the invention as defined by the appended claims.

I claim:

1. For use in an aerosol container, a product bag, said product bag including a neck terminating in a radially outwardly directed annular flange for positioning between a container flange and a valve cup flange, said product bag being improved by said neck below said annular flange having a resiliently axially collapsible portion, said axially collapsible portion being in the form of a radially inwardly directed and radially outwardly opening V-shaped cross section neck portion with said V-shaped neck portion being formed in said open state, said V-shaped neck portion being disposed immediately below and radially inwardly of said annular flange for compressive engagement by a valve cup.

2. An aerosol container product bag according to claim 1 wherein said product bag neck includes a short cylindrical portion between said annular flange and said V-shaped neck portion.

3. An aerosol container bag according to claim 2 wherein said product bag neck includes a short cylindrical portion below said V-shaped neck portion.

4. An aerosol container product bag according to claim 1 wherein said product bag neck includes a short cylindrical portion below said V-shaped neck portion.

5. An aerosol container product bag according to claim 2, 3, 4 or 1 wherein said resiliently axially collapsible portion forms means for automatically lifting said annular flange and a valve cup seated on said annular flange above an associated container flange for the filling of a propellant into an associated container.

6. An aerosol container assembly comprising a container having an upper end portion terminating in a container flange defining an opening, a product bag seated in said container and having a neck extending through said opening and terminating in an annular flange which overlies said container flange, and a valve cup for closing said opening, said valve cup including a sealing flange for cooperation with said container flange to sealingly close said opening, means securing said sealing flange to said annular flange with said product bag neck supporting said valve cup and said annular flange spaced above said container flange and said product bag neck being smaller than said opening wherein a passage is automatically formed below said valve cup and around said product bag for propellant charging.

7. An aerosol container assembly according to claim 6 wherein said product bag neck includes an axially collapsible resilient portion below and adjacent to said annular flange for permitting a resiliently resisted foreshortening of said neck sufficient to permit axial downward movement of said valve cup to a seating engagement on said container flange with said annular flange clamped therebetween.

8. An aerosol container assembly according to claim 7 wherein said axially collapsible neck portion is of a radially inwardly directed V-shaped cross section.

9. An aerosol container comprising a container having an upper end portion terminating in a container flange defining an opening, a product bag seated in said container and having a neck generally within said opening, said neck being of a lesser size than said opening and terminating in an annular flange seated on said container flange, and a vlave cup seated in said opening and having a sealing flange clampingly engaged with said container flange in sealed secured relation, the improvement residing in that said product bag neck is axially inwardly compressively engaged by said valve cup and said neck has adjacent said valve cup an axially compressed resiliently axially extensible portion for lifting said valve cup and said annular flange above said container flange to facilitate the charging of propellant into said container around said product bag.

10. An aerosol container according to claim 9 wherein said resiliently axially extensible portion is initially of a radially inwardly directed V-shaped cross section.

11. A method of filling an aerosol container with a propellant wherein said aerosol container is of the type including a product bag, said method comprising the step of providing a container having an upper portion terminating in a container flange defining an opening, providing a product bag having a neck terminating in an annular flange, placing the product bag in the container with the neck extending out through the container opening and the annular flange overlying in axially spaced relation the container flange, placing a valve cup on the product bag with a sealing flange of the valve cup engaging the annular flange, pressing the valve cup down to temporarily seat the annular flange on the container flange and bonding the annular flange to the sealing flange, releasing the valve cup with the product bag pushing the valve cup upwardly and spacing the annular flange above the container flange, and then directing a propellant into the container between the container flange and the annular flange and then through the opening around the product bag neck.

12. A method according to claim 11 wherein the container is then closed by again moving the valve cup down to tightly clamp the annular flange between the sealing flange and the container flange.

* * * * *